US011046501B1

(12) United States Patent
Mogan

(10) Patent No.: US 11,046,501 B1
(45) Date of Patent: Jun. 29, 2021

(54) INSULATION SLEEVE FOR BEVERAGE CONTAINER

(71) Applicant: Michael Mogan, West Chester, PA (US)

(72) Inventor: Michael Mogan, West Chester, PA (US)

( * ) Notice: Subject to any disclaimer, the term of this patent is extended or adjusted under 35 U.S.C. 154(b) by 162 days.

(21) Appl. No.: 16/112,848

(22) Filed: Aug. 27, 2018

Related U.S. Application Data

(60) Provisional application No. 62/550,716, filed on Aug. 28, 2017.

(51) Int. Cl.
*B65D 81/38* (2006.01)
*A47G 23/02* (2006.01)

(52) U.S. Cl.
CPC ..... *B65D 81/3876* (2013.01); *A47G 23/0216* (2013.01)

(58) Field of Classification Search
CPC ..... B65D 1/265; B65D 35/56; B65D 35/565; B65D 59/00; B65D 59/04; B65D 71/14; B65D 81/3876; B65D 5/6617; B65D 5/6688; B65D 81/027; A47G 23/02; A47G 23/0208; A47G 23/0216; A47G 23/0241; A47G 23/0258; A47G 23/0266; A47G 2023/0275; A47G 2023/0283; A47G 2023/0291
USPC ..... 220/737, 738, 739, 740, 592.2, 592.24, 220/903; 215/386, 387, 390; 222/131, 222/183
See application file for complete search history.

(56) References Cited

U.S. PATENT DOCUMENTS

| | | | | | |
|---|---|---|---|---|---|
| 1,632,347 | A | | 6/1927 | Pipkin | |
| 1,891,892 | A | | 12/1932 | Pipkin | |
| 3,257,025 | A | * | 6/1966 | Jolly | B65D 81/3876 220/739 |
| 3,473,682 | A | * | 10/1969 | Studen | A47G 23/0216 215/12.1 |
| 3,738,529 | A | * | 6/1973 | Rose | B65D 25/34 220/739 |
| 4,194,627 | A | * | 3/1980 | Christensen | B65D 25/34 206/545 |
| 4,871,597 | A | * | 10/1989 | Hobson | B32B 27/12 428/36.1 |
| 5,065,879 | A | * | 11/1991 | King | B65D 81/3886 150/154 |
| 5,148,932 | A | * | 9/1992 | Orefice | B65F 1/0053 220/23.2 |
| 5,445,315 | A | | 8/1995 | Shelby | |
| 5,934,100 | A | | 8/1999 | Hornick | |
| 6,068,182 | A | | 5/2000 | Tokunaga | |
| 6,557,751 | B2 | | 5/2003 | Puerini | |
| 6,648,140 | B2 | * | 11/2003 | Petricca | A45D 27/225 206/356 |

(Continued)

OTHER PUBLICATIONS https://beersy.com. Date unknown. pp. 1-5.
Custom Koozie. Webpage of prior art beverage container insulation sleeves. 7 pages.

*Primary Examiner* — Kareen K Thomas
(74) *Attorney, Agent, or Firm* — Joseph E. Maenner; Maenner & Associates, LLC

(57) ABSTRACT

A beverage can insulating sleeve is provided. The inventive sleeve uses less material and wastes less source material than standard sleeves. Two methods of manufacturing the sleeve are also provided.

13 Claims, 7 Drawing Sheets

(56) References Cited

U.S. PATENT DOCUMENTS 6,655,543 B2 * 12/2003 Beuke ..... B65D 81/3876 220/739
6,986,438 B2 * 1/2006 Leung ..... B65D 81/3876 220/737
7,000,801 B2 2/2006 Rodriguez
7,337,915 B1 * 3/2008 Weldon ..... A47G 23/0225 220/483
D605,902 S * 12/2009 Reinthaler ..... D7/624.3
7,753,589 B2 * 7/2010 Palt ..... F17C 13/084 383/66
7,815,047 B2 10/2010 Trimarco
7,858,015 B2 12/2010 Urquhart et al.
8,104,636 B2 * 1/2012 Crain ..... B65D 81/3876 220/739
9,051,754 B2 * 6/2015 Mallookis ..... E04H 15/50
9,339,134 B1 * 5/2016 Poole ..... B65D 43/162
D778,734 S 2/2017 Odikor
D778,735 S 2/2017 Wofford
9,795,235 B1 * 10/2017 Bouse ..... A47G 23/0216
D853,202 S * 7/2019 Welham ..... D7/607
2002/0104845 A1 * 8/2002 Beuke ..... B65D 81/3876 220/739
2003/0111475 A1 * 6/2003 Cheng ..... B65D 81/3876 220/739
2003/0146228 A1 8/2003 Davis et al.
2006/0091143 A1 * 5/2006 Chantalat ..... B65D 81/3879 220/737
2006/0150656 A1 7/2006 Lu
2006/0186129 A1 8/2006 Allnutt et al.
2006/0231606 A1 10/2006 Katchko et al.
2007/0145108 A1 * 6/2007 Dexel ..... B65D 81/3876 229/403
2007/0272753 A1 11/2007 Rebelak, Sr. et al.
2008/0041864 A1 * 2/2008 Wong ..... B65D 81/3865 220/738
2009/0302047 A1 12/2009 Andersen
2011/0192859 A1 8/2011 Belford
2012/0312830 A1 * 12/2012 Berry-Smith ..... A47G 23/0266 220/737
2013/0075412 A1 3/2013 Schminke
2013/0200091 A1 8/2013 Scott-Womack
2014/0131372 A1 5/2014 Hiner
2014/0339240 A1 11/2014 Moore
2014/0353324 A1 12/2014 Crain
2015/0096995 A1 * 4/2015 Cunningham ..... B65D 81/3876 220/739
2015/0108146 A1 4/2015 Jameson et al.
2015/0191293 A1 7/2015 Forcella
2015/0291313 A1 10/2015 Vara
2019/0168947 A1 * 6/2019 Luchak ..... B65D 81/3879
2019/0263564 A1 * 8/2019 Robertaccio ..... B65D 81/3876

* cited by examiner

STEP 208

STEP 210

STEP 216

INSULATION SLEEVE FOR BEVERAGE CONTAINER

CROSS-REFERENCE TO RELATED APPLICATION

The present application claims the benefit of U.S. Provisional Patent Application Ser. No. 62/550,716, filed on Aug. 28, 2017, which is incorporated herein by reference in its entirety.

BACKGROUND OF THE INVENTION

Insulation sleeves that are slid over cold beverage containers, such as 12 ounce aluminum cans, have been in common use for a considerable period. The prior designs include many beverage holders, but none just like this presentation. While other variations exist, the above-mentioned designs for beverage sleeves and coasters are typical of those encountered.

It would be beneficial to provide a thin cold beverage sleeve adaptable to the standard U.S. 12 ounce aluminum can.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
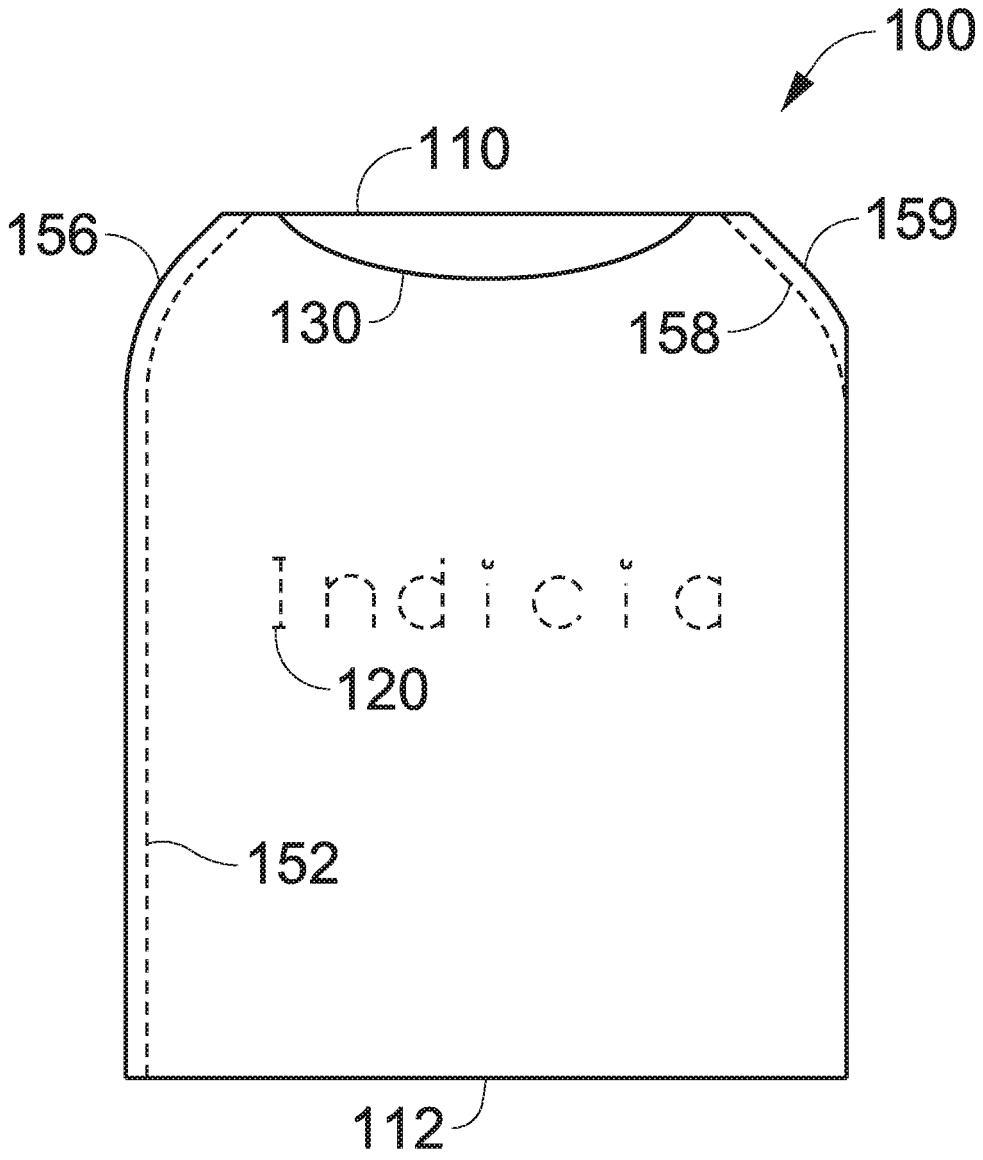
FIG. 1 is a side elevational view of an insulation sleeve for beverage container according to an exemplary embodiment of the present invention.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

The present invention provides a thin beverage sleeve that will insulate an aluminum can and protect the user from cold and moisture. The inventive sleeve can be easily attached to the aluminum can by slipping the sleeve over the top of the can. The sleeve fits tightly over the can, is form fitting, covers the entire can label, and is aesthetically pleasing. The sleeve does not cover the bottom of the can. In other words, it would be difficult to notice that the can has a sleeve on it from a distance.

Optionally, the sleeve is capable of displaying advertising or can be personalized with screen printing. It is desired that the sleeve is washable and reusable. Further, the sleeve is absorbent and will keep sweating aluminum cans from dripping on a user's hands, clothing or surface that the can is setting on.

As shown in FIG. 1, the present invention is a thin beverage can insulating sleeve 100 ("sleeve 100") that is used to cover cold beverages in standard U.S. 12 ounce aluminum cans. An exemplary can 50 is shown in FIG. 2 and the application of sleeve 100 over can 50 is shown in FIG. 3.

Figure 2:
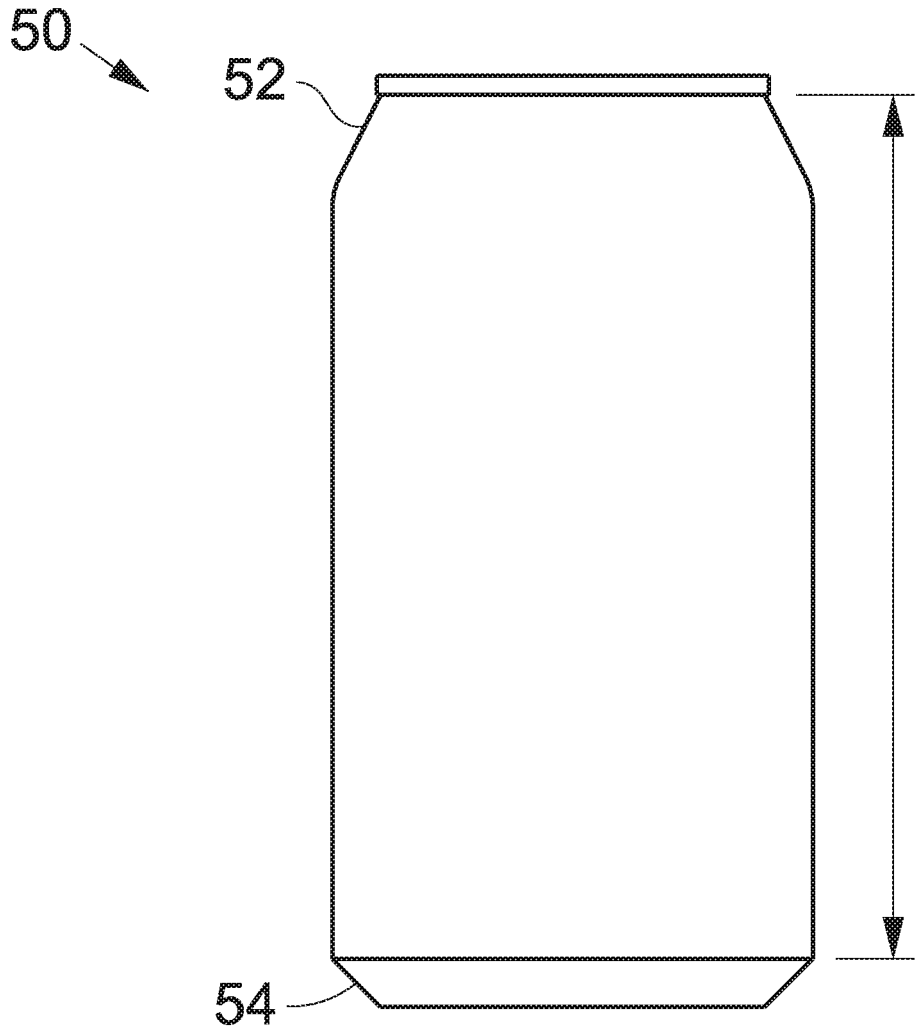
FIG. 2 is a side elevational view of an exemplary beverage can for use with the sleeve shown in FIG. 1.
Figure 3:
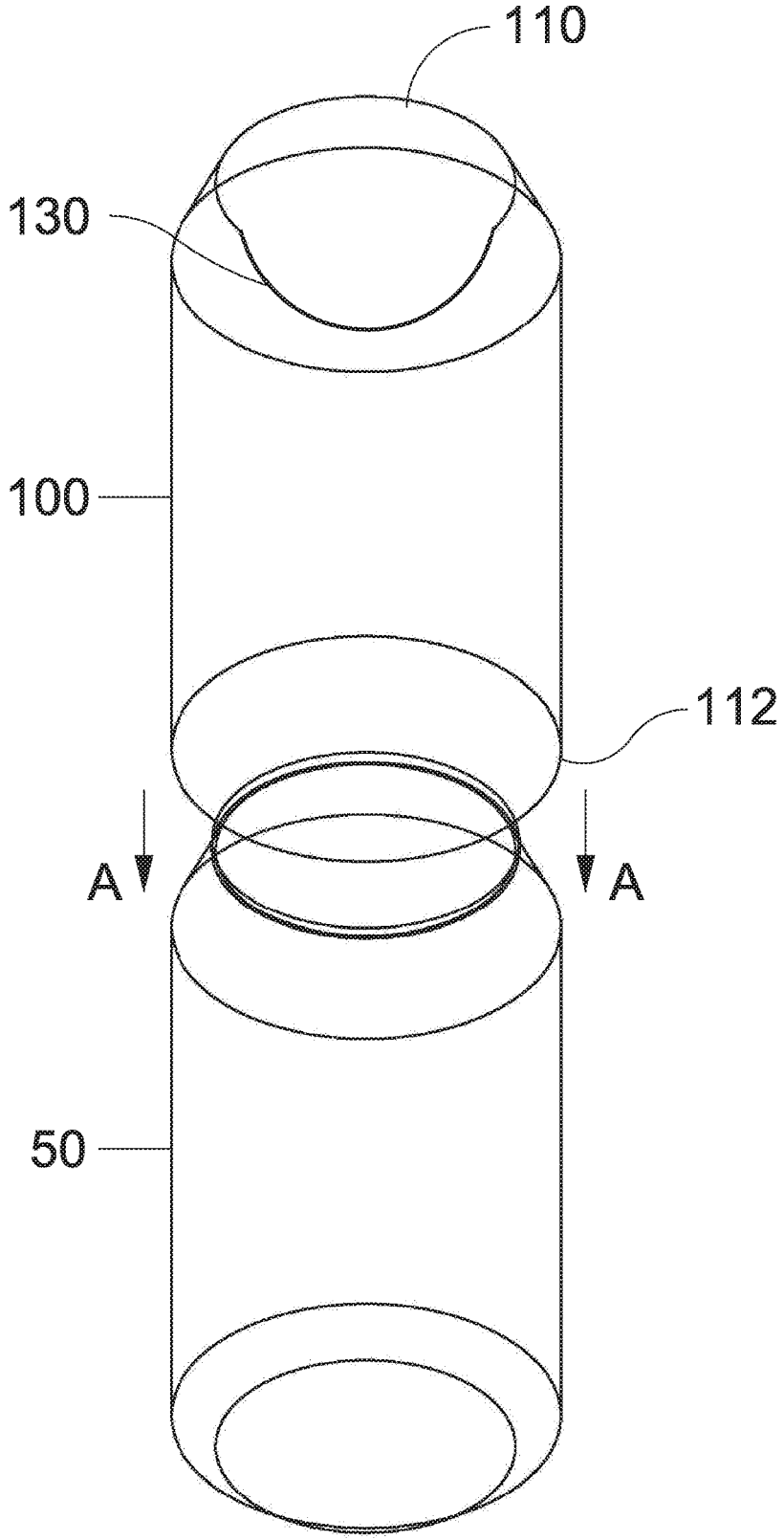
FIG. 3 is a perspective view of the sleeve of FIG. 1 being slid onto the container of FIG. 2.
Figure 4:
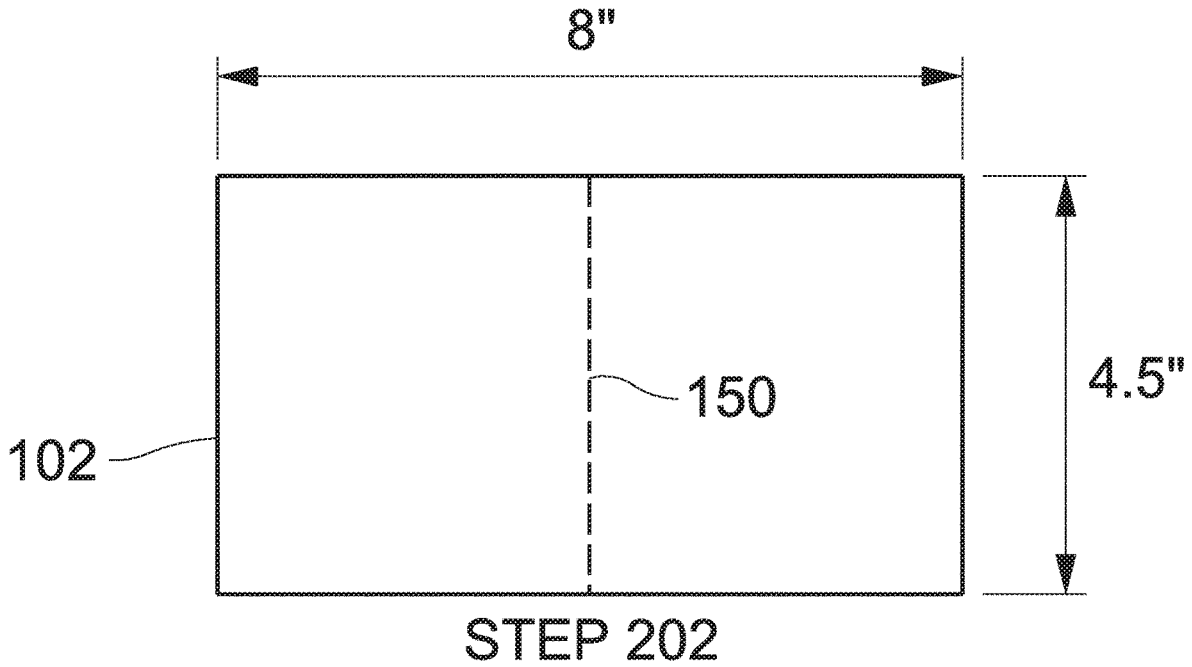
FIG. 4 is a top plan view of a fabric sheet used to make the sleeve of FIG. 1.
Figure 5:
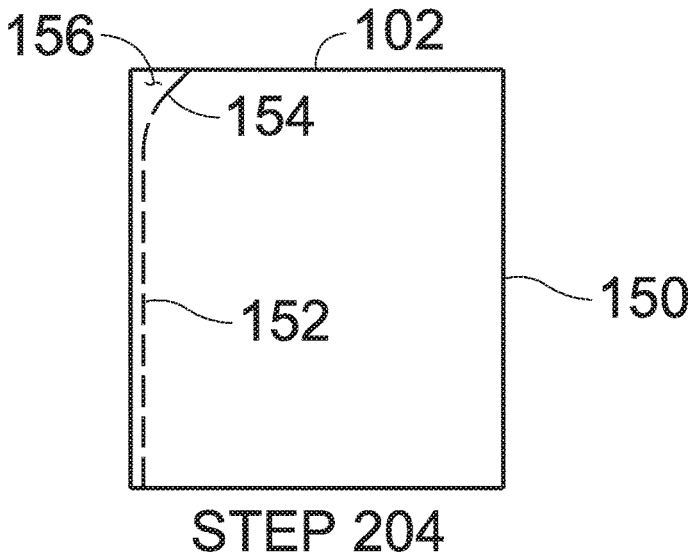
FIG. 5 is a top plan view of seams sewn into the fabric of FIG. 4.
Figure 6:
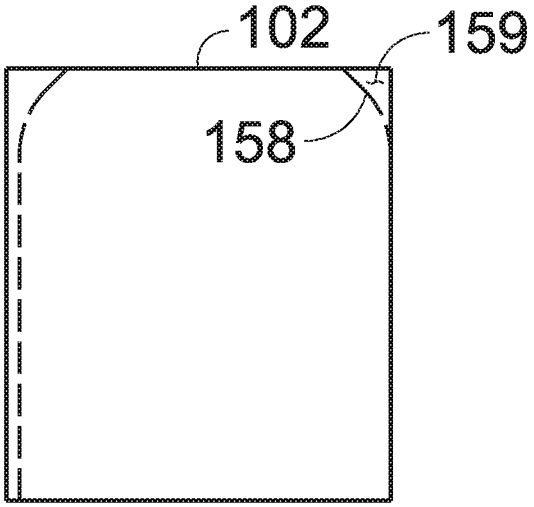
FIG. 6 is a top plan view showing a seam sewn into the fabric of FIG. 5 for a chamfer.
Figure 7:
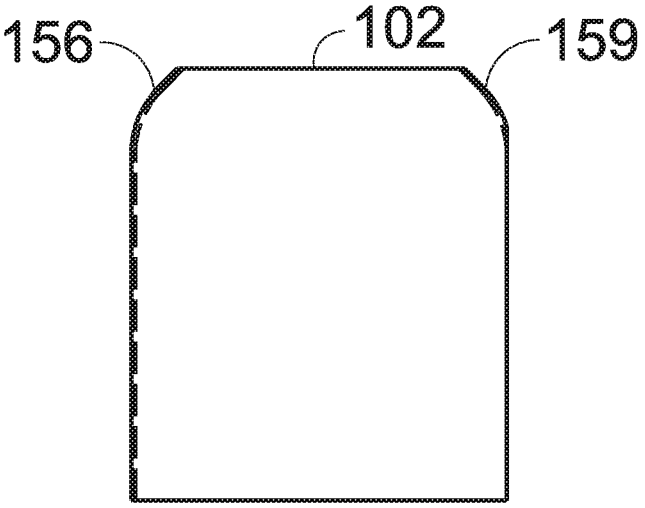
FIG. 7 is a top plan view of chamfers having been cut from the fabric of FIG. 6.
Figure 8:
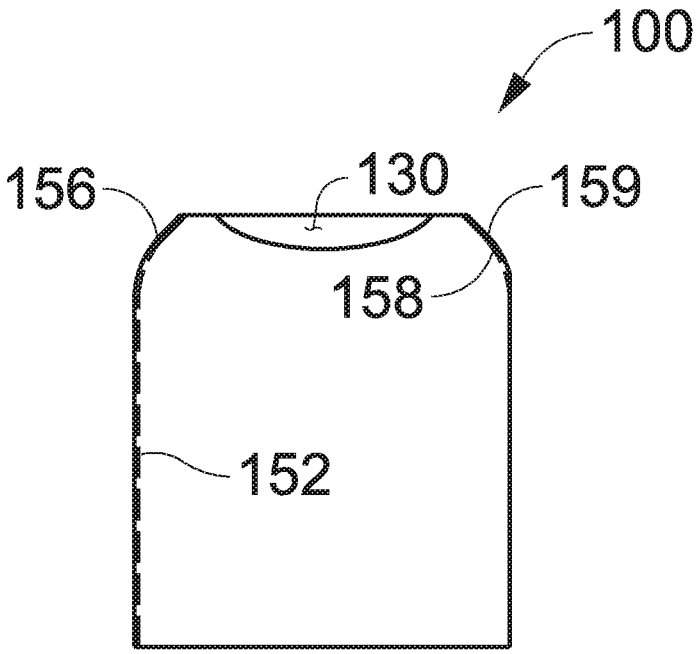
FIG. 8 is a top plan view of a lip cutout being cut in the fabric.

Referring to FIGS. 1-3, sleeve 100 is a tubular band formed from one unitary, single piece of fabric 102 having an opening on both a top end 110 and a bottom end 112, with a taper at top end 110, allowing the user to cover a standard U.S. 12 ounce aluminum can 50. Sleeve 100 can be constructed from an expandable material, such as, for example, a 1.5 mm thick neoprene rubber with polyester or nylon fabric on both sides, or any similar material that will insulate and easily stretch over can 50 and fit snugly covering can 50 from the top lip 52 of can 50 to the bottom portion 54 of can 50. Sleeve 100 is sweat absorbing such that condensation on can 50 will be absorbed and reduce dripping on any other surfaces.

Logos or other indicia 120 can be printed on the exterior of sleeve 100. Indicia 120 that can be applied with screen printing. An ink used for elastic fabrics can be used to help prevent cracking. In lieu of screen printing, textile printed fabrics can be used to create designs on fabric 102.

Many different fabrics can be used to manufacture sleeve 100, as long as the material is insulating, stretchy, thin, and absorbing. The above-mentioned materials can be satisfactory materials due to their insulating capabilities, thinness, shiny appearance, elasticity, and absorptive properties.

FIG. 3 shows how sleeve 100 is slid over a standard U.S. 12 ounce aluminum can 50 in the direction of arrows "A". The material is stretchy enough to be slid on from the top or bottom of can 50, but to reduce wear on sleeve 100, it is suggested to slide sleeve 100 over the top lip 52 of can 50. Sleeve 100 is pulled down to where the top end 110 of sleeve 100 is just below the lip 52 at the top of can 50. Optionally, as shown in FIG. 1, a lip cutout 130 can be cut out of top end 110 of sleeve 100. When placing sleeve 100 over can 50, lip cutout 130 can be aligned with the opening in can 50 such that, when the user places can 50 against his/her lips to drink from can 50, the user's lips do not engage sleeve 100.

Referring to FIGS. 4-8, to make sleeve 100, start off with a unitary, single piece of fabric 102, composed of neoprene rubber with polyester or nylon fabric on both sides or similar material, that is approximately 8" wide by 4.5" tall. In step 202, (FIG. 4) fold the fabric in half along crease 150. In step 204, (FIG. 5), sew a seam 152 along the left edge 154 and first chamfer 156, which is offset 0.5" down from the top and 0.5" over from the vertical seam 152. A curve with an approximate radius of 1" connects the vertical seam 152 and diagonal seam 154. In step 208 (FIG. 6), sew seam 158 along second top chamfer 159, which is offset 0.5" down from the top and 0.5" over from the crease 150. The seam 158 is curved with approximate radius of 1" tangent to the top end 110 of fabric 102.

In step 210 (FIG. 7), cut fabric close (about 1/16") to the seams 152, 154, and 158. In step 214, turn the fabric inside out so that the seams 152, 154, 158 are on the inside. The completed sleeve 100 is approximately 4.5" tall by 3.75" wide with 0.5" curved chamfers on the top right and left sides. Optionally, in step 216 (FIG. 8), lip cutout 130 can be cut out in an elliptical arc having a long side of about 1.5 inches and a short side of between about 0.25 inches and about 0.375 inches.

After completion, sleeve 100 has a generally tubular band with a generally frusto-conical top having a lip cutout in the top.

In relation to the prior art can insulator known as the KOOZIE®, sleeve 100 uses 22% less fabric, having fabric dimensions of 4.5"×8" (36 $in^2$), vs. KOOZIE® fabric dimensions of 4.5"×10.25" (46.13 $in^2$). Additionally, sleeve 100 has a shorter seam length of 5.5", compared to an 8" seam length for KOOZIE®. Further, In relation to the KOOZIE®, sleeve 100 wastes 90% less fabric during the manufacturing process.

sleeve 100 wasted fabric: 0.5 $in^2$

KOOZIE® wasted fabric: 5.21 $in^2$ 0.5/5.21=10%

In relation to the KOOZIE®, sleeve 100 does not cover the bottom of a can, resulting in the can being more stable when placed on a flat surface.

In relation to the KOOZIE®, sleeve 100 uses a thinner neoprene material, allowing a can to fit into cup holders that are more narrow.

The below chart illustrates a comparison in the change in temperature of a can of beverage (soda) over a 45 minute period in a room with the temperature ranging between 100-110 degrees F., with a "Control" can being non-insulated, a can insulated by sleeve 100, and a can insulated by a KOOZIE® sleeve.

| Time (min) | Control Temp. (degrees F) | Δ Temp. | Sleeve 100 Temp. (degrees F) | Δ Temp. | KOOZIE Temp. (degrees F) | Δ Temp. |
|---|---|---|---|---|---|---|
| 0 | 36.2 | | 37.5 | | 36.2 | |
| 5 | 41.6 | 5.4 | 40.4 | 2.9 | 38.4 | 2.2 |
| 10 | 45.4 | 9.2 | 43.2 | 5.7 | 41.4 | 5.2 |
| 15 | 49.3 | 13.1 | 46.5 | 9 | 43.5 | 7.3 |
| 20 | 52.2 | 16 | 48.4 | 10.9 | 46.5 | 10.3 |
| 25 | 55.4 | 19.2 | 51.2 | 13.7 | 48.4 | 12.2 |
| 30 | 58.1 | 21.9 | 53.6 | 16.1 | 50.3 | 14.1 |
| 35 | 60.4 | 24.2 | 54.4 | 16.9 | 52.7 | 16.5 |
| 40 | 62.3 | 26.1 | 56.4 | 18.9 | 54.2 | 18 |
| 45 | 64.5 | 28.3 | 58.4 | 20.9 | 55.4 | 19.2 |

Throughout the 45 minute test period, at 5 minute intervals, the A Temp. of the beverage insulated by sleeve 100 was only slightly higher than the A Temp. of the beverage insulate by the KOOZIE® sleeve. Applicant believes that cost savings in material and manufacturing offset the slight temperature losses of sleeve 100 compared to the KOOZIE® sleeve.

Figure 9:
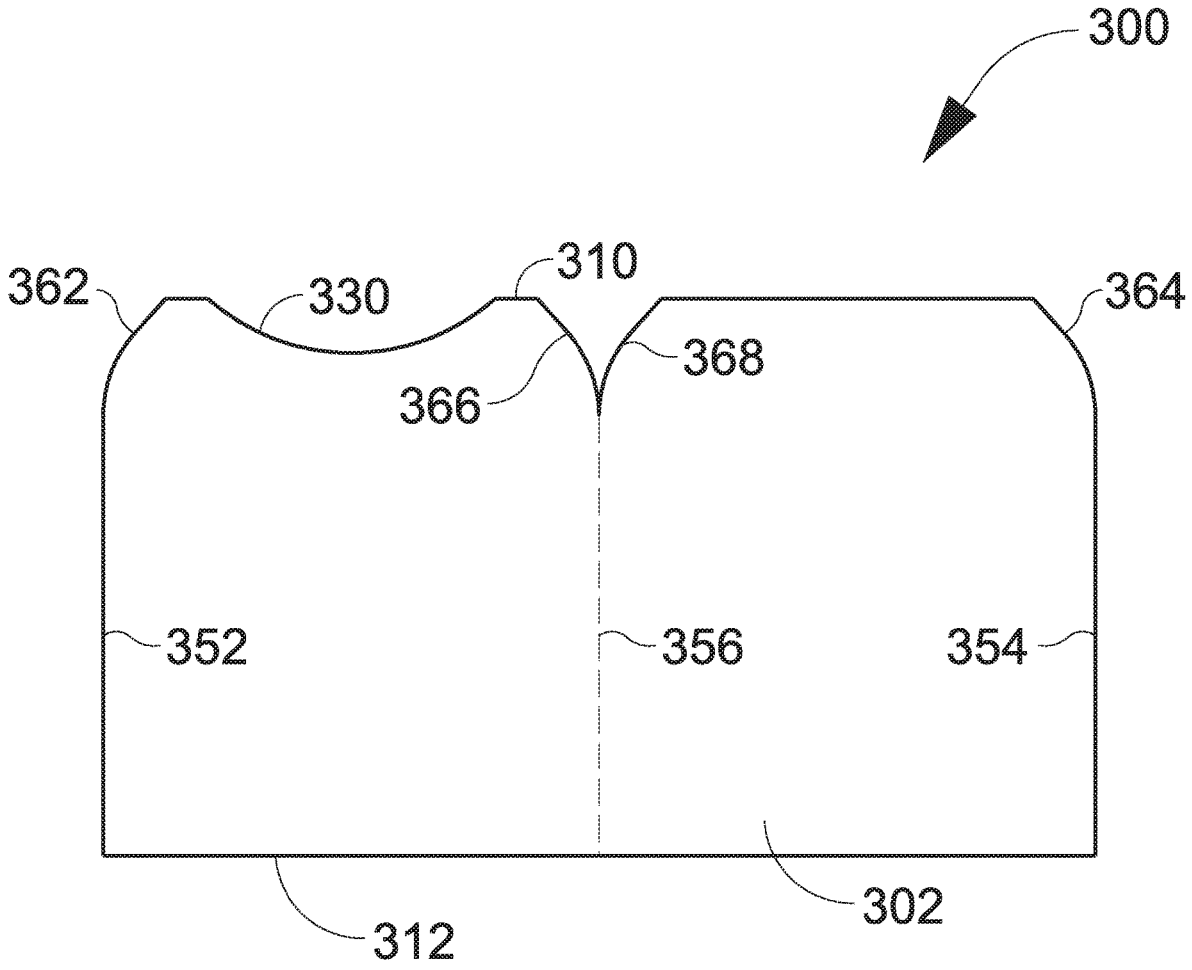
FIG. 9 is a top plan view of a cut sleeve prior to sewing according to an alternative exemplary embodiment of the present invention.

Alternatively, instead of folding the fabric and sewing the fabric in steps 202-208 prior to cutting the fabric in step 210, a sleeve 300 can be formed by cutting a fabric 302 to a shape as shown in FIG. 9 (or similar) prior to sewing or otherwise connecting the sides of the fabric with each other.

Vertical, parallel sides 352, 354 and are connected to each other along a bottom side 312. A centerline 356 running parallel to sides 352, 354 is also provided. A lip cutout 330 is formed along a top side 310 between side 352 and centerline 356.

Curved chamfers 362, 364, 366, 368 are formed along the top side 310. Chamfer 362 is formed between side 352 and top side 310; chamfer 364 is formed between side 354 and top side 310; chamfer 366 is formed between centerline 356 and top side 310 toward lip cutout 330; and chamfer 368 is formed between centerline 356 and top side 310 away from lip cutout 330.

To form completed sleeve 300, sides 352, 354 are brought together and connected to each other along their respective lengths, such as by sewing. Chamfer 362 is connected to chamfer 364 and chamfer 366 is connected to chamfer 368. Sides 352, 354 and chamfers 362, 364 can be connected by a single unitary seam. The connected chamfers 362/364, 366/368 eliminate any "bulge" at the chamfer seams and allow sleeve 300 to "hug" the top corner of a standard beverage can.

While the sizes used and described above are for use with a standard 12 ounce beverage can, those skilled in the art will recognize that this same process can be used to make different size sleeves for different size cans, but using different dimensions for the sleeve material.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A beverage can insulating sleeve for use with a beverage can having a body, a top rim with a diameter less than that of the body of the can, and a tapered portion extending between the body and the top rim, the sleeve comprising:

a tubular band having an open bottom sized to allow the body of the beverage can to be inserted therethrough; and a frusto-conical top connected to the tubular band, wherein the frusto-conical top is configured to match and engage the tapered portion of the beverage can, wherein the sleeve has a first configuration when the body of the beverage can is inserted into the sleeve and a second configuration when the beverage can is not inserted into the sleeve, wherein the first configuration and the second configuration are the same.

2. The beverage can insulating sleeve according to claim 1, wherein the frusto-conical top has a lip cutout formed therein.

3. The beverage can insulating sleeve according to claim 2, wherein the lip cutout comprises an elliptical arc.

4. The beverage can insulating sleeve according to claim 1, wherein the sleeve comprises a unitary piece of material.

5. The beverage can insulating sleeve according to claim 1, wherein the sleeve is constructed from a water absorbing material.

6. The beverage can insulating sleeve according to claim 1, wherein the sleeve is constructed from an expandable material.

7. The beverage can insulating sleeve according to claim 1, wherein the band is sized to extend generally the length of a 12 ounce beverage can.

8. A beverage can insulating sleeve for use with a beverage can having a tapered top end and a bottom portion disposed away from the top end, the sleeve comprising:

a unitary piece of material formed in a loop and having a first end and a second end, the first end being chamfered to form a frusto-conical top, wherein the frusto-conical top is configured to match the tapered top end of the beverage can, wherein the sleeve has a first configuration when the beverage can is inserted into the sleeve and a second configuration when the beverage can is not inserted into the sleeve, wherein the first configuration and the second configuration are the same.

9. The beverage can insulating sleeve according to claim 8, wherein the top has a lip cutout formed therein.

10. The beverage can insulating sleeve according to claim 9, wherein the lip cutout comprises an elliptical arc.

11. The beverage can insulating sleeve according to claim 8, wherein the unitary piece of material has a first side and a second side connected to the first side at a seam.

12. The beverage can insulating sleeve according to claim 11, wherein the seam extends to and includes the frusto-conical top.

13. The beverage can insulating sleeve according to claim 1, wherein the frusto-conical top is configured to cover a tapered portion of the can below the top lip.

* * * * *